US005518544A

United States Patent [19]

Higginson

[11] Patent Number: 5,518,544

[45] Date of Patent: May 21, 1996

[54] APPLICATOR FOR APPLYING A SURFACE TREATMENT

[76] Inventor: Philip J. Higginson, 114 Mill Lane, North Hykeham, Lincoln, United Kingdom, LN6 9PE

[21] Appl. No.: 946,417

[22] PCT Filed: May 8, 1991

[86] PCT No.: PCT/GB91/00733

§ 371 Date: Sep. 14, 1993

§ 102(e) Date: Sep. 14, 1993

[87] PCT Pub. No.: WO91/17313

PCT Pub. Date: Nov. 14, 1991

[30] Foreign Application Priority Data

May 10, 1990 [EP] European Pat. Off. ..... 903005021

[51] Int. Cl.[6] ..... B05C 5/00

[52] U.S. Cl. ..... 118/315; 118/323; 404/101; 404/108; 404/110; 404/111

[58] Field of Search ..... 118/315, 323; 404/101, 108, 110, 111

[56] References Cited

U.S. PATENT DOCUMENTS 1,165,331 12/1915 Gray ..... 404/111
4,066,723 1/1978 King et al. ..... 404/108
4,770,117 9/1988 Hetherington ..... 118/300

FOREIGN PATENT DOCUMENTS 1277568 10/1961 France .
2576336 7/1986 France .
3829716 5/1990 Germany .
2121853 1/1984 United Kingdom .

*Primary Examiner*—Jill Warden
*Assistant Examiner*—Jan M. Ludlow
*Attorney, Agent, or Firm*—Jones, Tullar & Cooper

[57] ABSTRACT

An applicator for mounting on a vehicle for applying a surface treatment of tar and/or bituminous binder material reinforced with glass fibres, such an applicator comprising an open bottomed spray bar housing (1), a fan (16) for producing a down-draft in the housing, at least one spray bar (5, 19) mounted on said housing and adapted to extend transversely of the direction of movement of the vehicle on which the applicator is mounted, a plurality of nozzles (6, 20) spaced longitudinally along the spray bar for spraying binder material, means (10) for controlling said nozzles, a plurality of sources (14, 24–28) for dispensing cut glass fibres through said open bottomed housing to the surface of binder material previously sprayed from the spray bar nozzles during use of the applicator, said sources being mounted at locations spaced along a plane substantially parallel to said spray bar, such that the glass fibres are dispensed substantially evenly onto the surface of binder material previously sprayed from the spray bar nozzles.

14 Claims, 3 Drawing Sheets

APPLICATOR FOR APPLYING A SURFACE TREATMENT

This invention relates to an applicator for mounting on a vehicle for applying a surface treatment of tar and/or bituminous binder material reinforced with glass fibres.

GB-A-2 081 603 describes a surface dressing comprising a binder which is reinforced with chopped glass fibres with a suitable aggregate then being added to the thus coated substrate to be bound thereto by the same binder as has been reinforced with glass fibres.

GB-A-2 121 853 describes an applicator for attachment to a vehicle for applying a surface dressing of the type described in GB-A-2 081 603. The applicator comprises an open-bottomed housing containing at least one spray bar mounted to said housing for spraying binder material from a plurality of nozzles placed longitudinally on the spray bar housing to extend transversely of movement of the vehicle when mounted to said housing and means for depositing cut glass fibres from the glass fibre distributor through the open bottomed housing onto the surface of a layer binder material previously sprayed from the spray bar nozzles.

A problem associated with the applicator disclosed by GB-A-2 121 853 is providing an even layer of chopped glass fibres, and controlling the distribution of this layer over a first binder layer provided by a first spray bar. It has been found that the layer of chopped glass fibres is dispensed unevenly and indeed can be deposited on areas where there is no binder material. The unevenness gives a less than satisfactory surface treatment and the glass fibres which do not settle on the strip of binder applied are wasted, which is economically, as well as environmentally inefficient.

A further problem with the device of the prior art is the circulation of air caused by the spray of bitumen in the applicator. It is inevitable that within the housing, a certain amount of bitumen spray is circulated in an updraft and attaches to the source of the glass fibre spray, and/or the glass fibre feeders. Without frequent maintenance and cleaning of the glass fibre sources and feeders, the sources and feeders will clog up and operation of the applicator will be halted.

The present invention seeks to overcome the problems of the prior art described above. Thus the present invention provides an applicator for mounting on a vehicle for applying a surface treatment of tar and/or bituminous binder material reinforced with glass fibres, such an applicator comprising an open bottomed spray bar housing, at least one spray bar mounted on said housing and adapted to extend transversely of the direction of movement of the vehicle on which the applicator is mounted, a plurality of nozzles spaced longitudinally along the spray bar for spraying binder material, means for controlling said nozzles, means for dispensing cut glass fibres through said open bottomed housing to the surface of binder material previously sprayed from the spray bar nozzles during use of the applicator, characterized in that the means for dispensing the cut glass fibres comprise a plurality of sources mounted in said housing and mounted at locations spaced along a plane substantially parallel to said spray bar, such that the glass fibres are dispensed substantially evenly onto the surface of binder material previously sprayed from the spray bar nozzles.

The plane along which the plurality of glass fibre sources are located is preferably a single straight line. Such an arrangement allows the plurality of sources to be powered easily by a single power supply but to operate individually.

The plurality of sources for the glass fibre are preferably similar in number, for example ±1 or 2 of the number of spray bar nozzles. Most preferably, the number of glass fibre sources are identical to the number of spray bar nozzles. Such an arrangement allows the plurality of nozzles and glass fibre sources to be arranged such that each glass fibre source is in substantially the same plane of the applicator in the direction of motion of the vehicle as an associated nozzle. Preferably, each pair of a nozzle and an associated glass fibre source is individually controllable.

The applicator optionally contains a second spray bar housing and spray bar mounted thereto mounted behind the source of glass fibre. The second spray bar, which is advantageously controllable independently of the first spray bar will usually have fewer nozzles than the first spray bar, and these nozzles are preferably in interleaving planes in the direction of motion of the vehicle to the nozzles of the first spray bar.

Desirably, the invention also comprises an applicator according to the invention which additionally comprises a means such as a fan for producing a downdraft in said applicator to distribute said fibres more evenly into the wet bitumen film. The downdraft created by the fan reduces the circulation of binder spray from the nozzles of the applicator, and thus protects the glass fibre choppers of the applicator from being clogged up with binder. The downdraft may be produced by a fan located above the source of the glass fibres and such a fan may be powered by any suitable means, e.g. electrically.

Preferably, the glass fibre source comprises a supply of a tow of glass fibre, means for supplying the tow to a chopper, and means for driving the chopper. The chopper and supply may be of a conventional type, for example a rotary pneumatically powered cutter which drags in the tow of glass fibres which are chopped into short lengths, for example 20 to 30 mm, which then fall perpendicularly onto a layer of binder provided by the first set of spray bar nozzles.

However, in a preferred embodiment of the invention, the glass fibre source comprises a novel chopper comprising a cylindrical cutter drum rotatable about its axis on a driveshaft, the drum comprising axially extending cutter blades protruding above the periphery of the drum at circumferentially spaced intervals, and a pressure roll for feeding a tow of glassfibre between said pressure roll and said drum, the cutter drum being continuously rotatable and the pressure roll being mounted on a pivotal arm which is individually pivotal by means of a fluid pressure operated piston and cylinder arrangement onto the surface of the cutter drum.

When the applicator of the invention, optionally fitted with a fan to produce a downdraft, contains a plurality of the novel choppers which form one aspect of the present invention, the cutter drums of said choppers may be mounted on a single driveshaft, which is continuously rotated, and the movement of the individual pressure rolls of said choppers onto and away from the cutter drum may be individually controlled. With such an arrangement, the width of the applicator across which glass fibres are sprayed is controlled by selecting which pressure rollers are positioned onto their corresponding cutter drums, and which are lifted away from said drums.

BRIEF DESCRIPTION OF THE DRAWINGS

The invention will be further described, by way of example, with reference to the accompanying diagrammatic drawings, in which:

Referring to FIG. 1 there is shown a spray bar housing 1 which has an open bottom and is provided with a plurality of nozzles for ejecting conical sprays of binder onto a surface 2 being dressed. In this embodiment an attachment bar 4 is shown mounted to the forward side of the housing 1 for securement of the applicator to the rear of a vehicle, conventionally a tanker from which liquid binder is supplied. A first spray bar 5 comprising a plurality of longitudinally spaced spray nozzle heads 6, from which conical jets of spray 12 of binder are projected, is mounted in the forward part of the housing 1. The heads 6 are provided with valves 10 individually connected to a supply conduit 8 connected to a binder supply hose. The valves 10 of the individual nozzles control the supply of binder through each spray nozzle.

Figure 1:
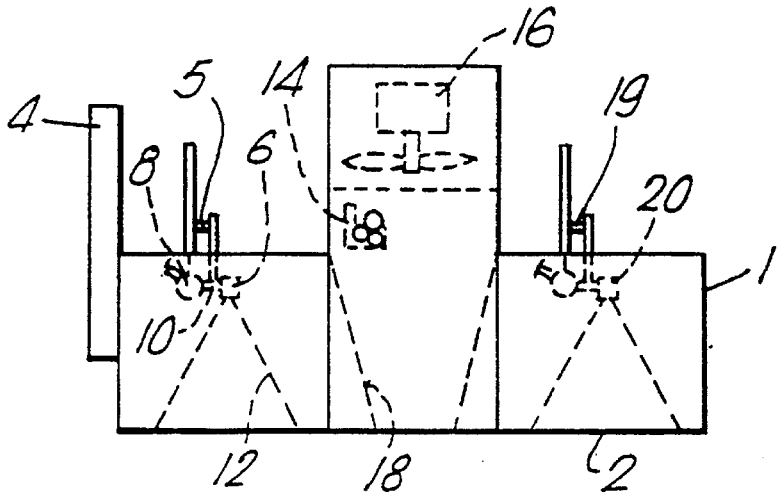
FIG. 1 is a side view of one embodiment of an applicator according to the invention.

The applicator housing 1, in its central portion, contains a plurality of choppers 14, the choppers 14 each being fed a tow of fibreglass which is chopped to produce short glass fibres, which fall substantially perpendicularly onto the surface 2 which has been coated with a first layer of binder from the nozzle 6. Situated above the plurality of choppers, is a fan 16 for the production of a downdraft of air in the housing 1, in order to reduce upward circulation of the binder spray 12 and evenly to distribute the spray of chopped glass fibres 18 onto the surface.

In the preferred embodiment of the invention illustrated by FIG. 1, a second spray bar 19 comprising an array of longitudinally spaced nozzles 20 distributes a further layer of binder over the surface 2 which has been sprayed. The nozzles 20 are located in spaced planes (parallel to the direction of movement of the vehicle) between the nozzles 6, thereby producing a more even surface treatment.

Figure 2:
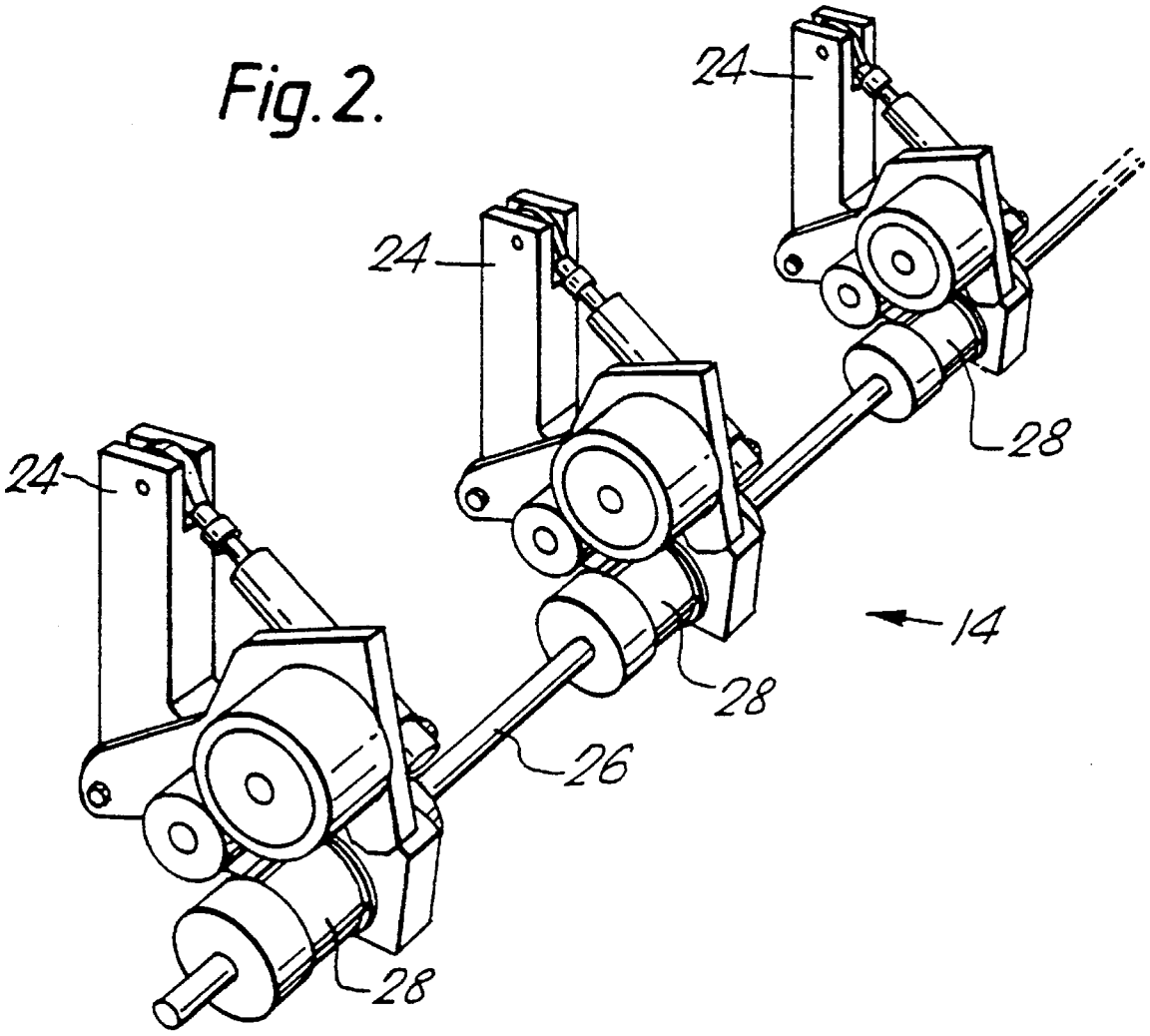
FIG. 2 is a perspective view of an array of choppers for use in the applicator of the invention.

FIG. 2 shows in more detail part of an array of a plurality of choppers according to the invention. A support bracket 24 is mounted to the applicator housing. The said bracket supports a drive shaft 26 onto which several cutter drums 28 are mounted. The choppers and their operation will be better understood by reference to FIG. 3.

Figure 3:
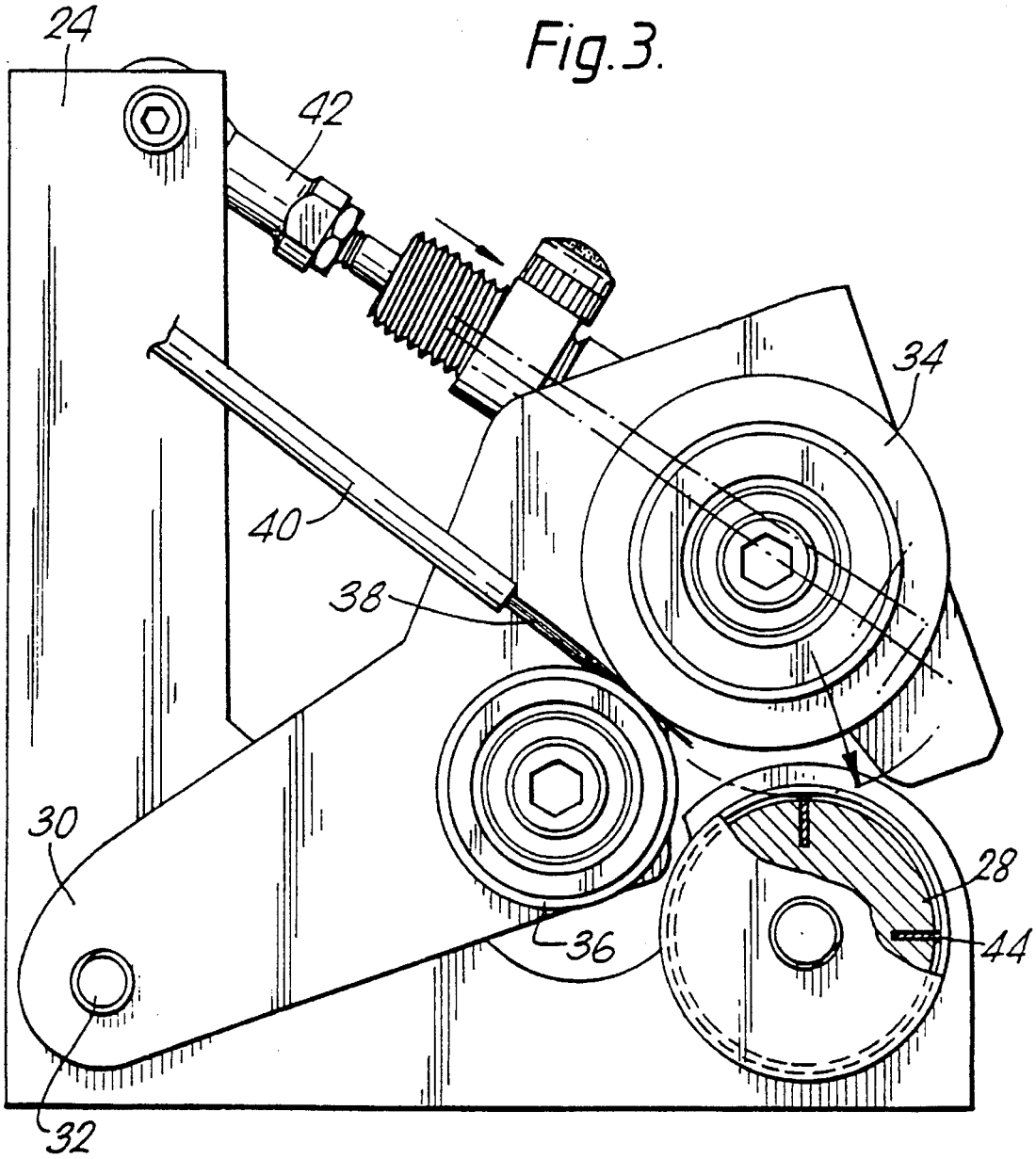
FIG. 3 is a side view of a chopper of FIG. 2.

FIG. 3 shows the side view of an individual chopper. A support bracket 24 supports the cutter drum 28 as illustrated in FIG. 2. The bracket 24 also supports a hinged arm 30 pivoted by a retaining means 32. The arm 30 contains a pressure roll 34 and a feed roll 36. In use, a tow of glass fibres 38, fed through a conduit 40 from a source (not illustrated) is passed into the nip of the pressure roll 34 when it is contact with the drum 28, and feed roll 36. The arm 30 is held in place by a piston and cylinder arrangement 42 fixed to the support bracket 24. The cylinder is connected to a suitable hydraulic or pneumatic supply. Upon actuation, the arm 30 moves about pivot 32 to bring the pressure roll 34 into contact with the cutter drum 28. In operation, the cutter drum 28 will be continuously rotating, thus imparting rotation to pressure roll 34, when it is in contact with the drum 28, and in consequence pulling the tow of glass fibres 38 over the cutter drum, causing the tow of fibres to be chopped by the cutter blades 44.

Figure 4:
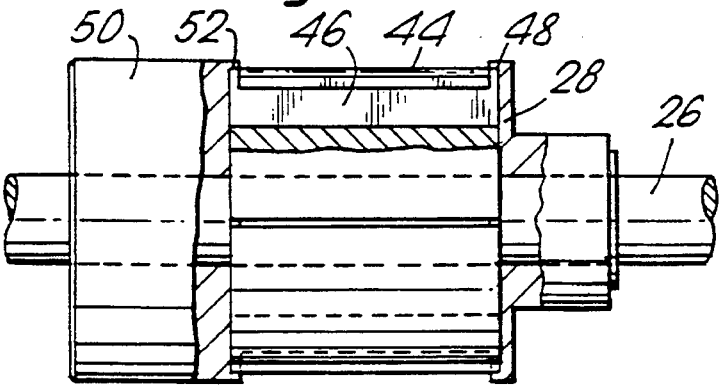
FIG. 4 is a plan view of a cutter drum of the chopper of FIG. 3.

FIG. 4 shows a cutter drum in further detail. The drum 28 is mounted on a drive shaft 26. Cutter blades 44 are held in axially extending slots in the surface of the drum. The blade 44 is retained in the slot by a retainer plate 46 and by an inturned rim 48 at one end and a bush 50 with an inturned rim 52 at the other. The bush 50 is fixed to the driveshaft by a retaining screw (not illustrated) which can be loosened, allowing the bush 50 to be moved along the drive shaft, allowing removal and replacement of the blades 44 and plates 46 from the cutter drum without the requirement to remove the drum from the drive shaft.

Figure 5:
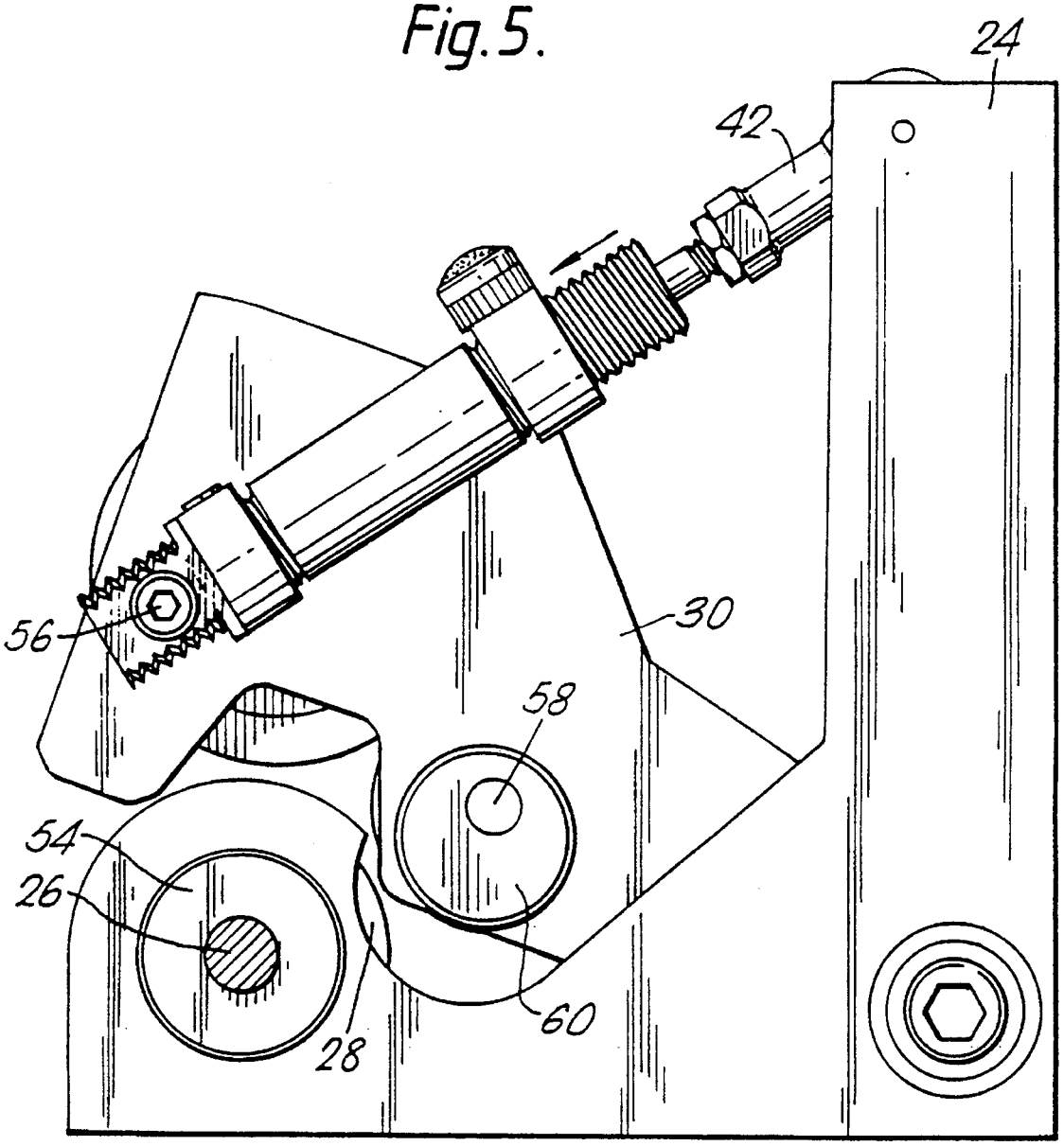
FIG. 5 is a side view of the chopper of FIG. 3, from the other side.

FIG. 5 shows the opposite side view to FIG. 3 showing piston 42 fixed by fixing means 56 to the arm 30. The Figure also shows a bush 54 mounted on the drive shaft 26 to stop lateral movement of the cutter drum 28 on the opposite side of the bracket 24. In the embodiment of the chopper of the invention illustrated, the feed roll 36 is mounted on an eccentric stub shaft 58 on a lockable rotatable support 60, in order that the position of the feed roll 36 may be adjusted relative to the pressure roll 34.

The binder as applied in use of the applicator of the invention is a conventional tar or bitumen emulsion binder with tar, bitumen or a tar and bitumen blend being used as convenient. Whereas normally applied hot, for example, using K170 bitumen which is a normal 70% bitumen emulsion, it can also be applied cold, for example, with K160 which contains 60% bitumen. In a particular embodiment, the operation of the spray bars is arranged so that a suitable thickness of bitumen is applied when the vehicle on which the applicator is mounted is moved forwardly at a speed of 1 to 2 km per hour.

The invention thus provides an applicator which can lay a more even distribution of glass fibres in a surface treatment than applicators of the prior art. Furthermore, through the use of individually operable spray nozzles and associated glass fibre sources, controlled widths of a surface treatment may be efficiently laid by the applicator.

I claim:

1. An applicator for mounting on a vehicle for applying a surface treatment of tar and/or bituminous binder material reinforced with glass fibres, such an applicator comprising:

an open bottomed spray bar housing having a vehicle mounting end;

at least one spray bar mounted in said housing parallel to said mounting end so as to extend transversely of a direction of movement of a vehicle on which the applicator is mounted:

a plurality of spray bar nozzles spaced along said spray bar for spraying bonder material on a surface to be treated;

a plurality of sources of cut glass fibres mounted in said housing, the number of sources of glass fibres being equal to the number of spray bar nozzles, said nozzles and said glass fibre sources being arranged such that each glass fibre source is in substantially a same plane of the applicator perpendicular to said mounting end as an associated nozzle to form a plurality of aligned nozzle-glass fibre source pairs, said pairs being at locations spaced along said spray bar for evenly dispensing cut glass fibres through said open bottomed housing onto said surface, each said spray nozzle being spaced between the mounting end and its associated source of glass fibres so that glass fibres are dispensed substantially evenly onto binder material on the surface to be treated; and individual control means for each nozzle-glass fibre source pair.

2. An applicator according to claim 1, further including a second spray bar having a plurality of spray nozzles mounted in said housing to extend substantially parallel to said first spray bar wherein said plurality of sources of glass fibre are located between said first and second spray bars.

3. An applicator according to claim 2, further including additional control means for controlling said second spray bar independently of said first spray bar.

4. An applicator according to claim 2, wherein the nozzles of said second spray bar are in interleaving planes with respect to the nozzles of said first spray bar.

5. An applicator according to claim 1, further including means for producing a downdraft within said housing to direct said glass fibres toward the surface to be treated for even distribution on the surface.

6. An applicator according to claim 5, wherein said means for producing a downdraft is a fan located to direct said glass fibres toward the surface to be treated.

7. An applicator according to claim 1, wherein each said source of glass fibres is a chopper comprising:

a continuously rotatable cylindrical cutter drum rotatable about its axis on a driveshaft, the drum comprising axially extending cutter blades protruding above the periphery of the drum at circumferentially spaced intervals:

a pivotal arm which is individually pivotal by means of a fluid pressure operated piston and cylinder arrangement; and a pressure roll mounted on said pivotal arm for feeding a tow of glass fibre between said pressure roll and said drum.

8. An applicator according to claim 7, wherein the number of sources of glass fibres is equal to the number of spray nozzles.

9. An applicator according to claim 8, where each of said glass fibre sources is in substantially a same plane of the applicator in said direction of motion as an associated nozzle to form a plurality of aligned nozzle-glass fibre source pairs.

10. An applicator according to claim 9, further including a second spray bar having a plurality of spaced nozzles mounted in said housing to extend substantially parallel to said first spray bar wherein said plurality of sources of glass fibre are located between said first and second spray bars.

11. An applicator according to claim 10, wherein the nozzles of said second spray bar are in interleaving planes with respect to the nozzles of said first spray bar.

12. An applicator according to claim 7, further including means producing a downdraft within said housing to direct said glass fibres toward the surface to be treated, and to prevent sprayed binder material from reaching said sources of glass fibres.

13. An applicator for mounting on a vehicle for applying a surface treatment of tar and/or bituminous binder material reinforced with glass fibres, such an applicator comprising:

an open bottomed spray bar housing having a vehicle mounting end;

at least one spray bar mounted in said housing parallel to said mounting end so as to extend transversely of a direction of movement of a vehicle on which the applicator is mounted:

a plurality of spray bar nozzles spaced along said spray bar for spraying binder material on a surface to be treated;

means for controlling said nozzles;

a plurality of sources of cut glass fibres mounted in said housing at locations spaced along a plane substantially parallel to said spray bar for evenly dispensing cut glass fibres through said open bottomed housing onto said surface, said spray nozzles and said glass fibre sources being spaced apart with said spray bar located between the mounting end and to said sources of glass fibres sot that glass fibres are dispensed substantially evenly onto binder material on the surface to be treated, each of said plurality of sources of glass fibres being a chopper comprising:

a continuously rotatable cylindrical cutter drum rotatable about its axis on a driveshaft, the drum comprising axially extending cutter blades protruding above the periphery of the drum at circumferentially spaced intervals;

a pivotal arm which is individually pivotal by means of a fluid pressure operated piston and cylinder arrangement; and a pressure roll mounted on said pivotal arm for feeding a tow of glass fibre between said pressure roll and said drum.

14. An applicator according to claim 13 characterized in that the arm of each chopper additionally comprises a feed roll positioned so that a tow of glass fibre is retainable between said pressure roll and said feed roll.

* * * * *